United States Patent [19]

Forrest

[11] 4,068,846

[45] Jan. 17, 1978

[54] PLACE-KICKING FOOTBALL RECEIVING TARGET

[76] Inventor: Charles Phelps Forrest, 1306 St. Stephens Road, Mobile, Ala. 36603

[21] Appl. No.: 709,004

[22] Filed: July 26, 1976

[51] Int. Cl.[2] ..... A63B 67/00

[52] U.S. Cl. ..... 273/55 B; 273/181 F; 273/181 A; 273/105 R; 273/102 S

[58] Field of Search ..... 273/55 B, 55 R, 26 A, 273/29 B, 181 A, 181 F, 105 R, 102 R, 105 A, 127 B, 102 S, 102.4, 105 R, 176 B, 30

[56] References Cited

U.S. PATENT DOCUMENTS

| | | | |
|---|---|---|---|
| 237,808 | 11/1975 | Ekstrand | 273/181 F X |
| 1,510,402 | 9/1924 | Hopwood | 273/105 R X |
| 2,201,865 | 5/1940 | Kriekard | 273/105 R |
| 3,215,432 | 11/1965 | Lee et al. | 273/181 A |
| 3,580,578 | 5/1971 | McCarthy | 273/105 R |
| 3,820,787 | 6/1974 | Heinbigner | 273/55 B |

FOREIGN PATENT DOCUMENTS

| | | | |
|---|---|---|---|
| 21,909 | 10/1906 | United Kingdom | 273/181 F |

*Primary Examiner*—Richard C. Pinkham
*Assistant Examiner*—T. Brown
*Attorney, Agent, or Firm*—Cameron, Kerkam, Sutton, Stowell & Stowell

[57] ABSTRACT

A football receiving target for practicing place-kicking and improving kicking skills at various distances. The target includes a vertically disposed rim structure, a net secured to the rim, and a pocket sewn in the net to receive footballs. The perimeter of the pocket opening is outlined with a pair of vertical straps and a horizontal strap to simulate the uprights and cross bar of a football goal post. A pair of removable auxiliary straps extend from the rim to the horizontal strap to limit the area of the pocket opening for practicing place kicks at different distances.

13 Claims, 7 Drawing Figures

PLACE-KICKING FOOTBALL RECEIVING TARGET

BACKGROUND OF THE INVENTION

The present invention pertains to an improved football practicing target which permits a kicker to practice place kicking without the assistance of a companion player who can receive and return the kicked balls promptly to the practice kicker, while at the same time gives the practice kicker an opportunity to practice place kicks of varying distances and improve his kicking accuracy.

Modern football is a game of specialists who can perform a specific task well. One such specialist is a place-kicker who is required to kick a football, held on a playing surface by another player, various distances at varying trajectories with a great degree of accuracy. To acquire these skills, a place-kicker puts in many long hours of practice perfecting his skills in kicking a football at different distances. On many of these practice sessions the kicker is unable to find a companion player to receive and return the kicked balls; therefore, he must use a number of footballs and retrieve them himself or use one of the presently available football practice targets. While a number of football practice targets are available, such, for the most part, are limited in their use. Some recently proposed practice targets include net structures which absorb the force of the kicked ball, while others simulate the goalpost and thereby afford and opportunity to practice place-kicking accuracy. However, these devices require the practice kicker to move farther from the target to simulate longer distances and, as such, a missed attempt may carry beyond the target requiring the kicker to stop practice to retrieve the loose balls.

Representative of the available practice target devices are those disclosed in U.S. Pat. Nos. 3,472,511; 3,675,922; 3,820,787; and 3,856,301. These prior art devices are suitable for limited place-kicking situations; however, they are not designed for a full range of actual football situations with which a place-kicker is presented in a game. With a greater importance on field goals and extra points in the game of football, greater emphasis is placed on a kicker being able to go into the game and accurately kick a football through the goalpost uprights from any distance. The further the kicker is from the goalpost the smaller the target becomes; therefore, he must be able to concentrate on practicing accuracy by kicking as many as possible kicks at different distances without worrying about running down loose balls.

Prior art U.S. Pat. No. 3,820,787 is directed to a football kicking device embodying a target formed by a rectangular frame simulating the cross bar and vertical posts of a goalpost, on which frame is mounted a flexible bag having its mouth connected to the frame, and of a length to loosely depend from the frame and operative to receive and retain a football which is kicked into it. The horizontal bar of the frame is vertically adjustable in accordance with the distance of the simulated kick. In addition, the distance between the upright arms of the frame is adjustable so as to vary the width of the target in dependence upon the distance of the simulated kick. However, any kick wide of the target will not be caught by the net and will have to be retrieved by the kicker.

U.S. Pat. No. 3,856,301 shows a portable frame and net for catching a football during practice kicking, the net being normally slack so as to move rearwardly and upwardly when a football is kicked into it.

In U.S. Pat. Nos. 3,472,511 and 3,675,922 devices for practicing field goal kicking are disclosed which include portable goal marks which rest on the ground and are adjustable to provide the proper target for kicks of varying distances.

SUMMARY OF THE INVENTION

The present invention provides a portable football practice target adapted for practicing place kicks of varying distances without the use of a regulation goalpost comprising:

a. a vertically disposed rim;
b. a net secured to the rim, said net having a cut-out;
c. a pocket having an open end and a closed end, the open end of the pocket being attached to the perimeter of the cut-out;
d. a pair of vertical straps and a horizontal strap fixed to the net substantially outlining the perimeter of the cut-out; and
e. a pair of removable auxiliary straps for positioning over the open end of the pocket thereby limiting the size of the opening, the straps hanging vertically from the rim and attachable to the horizontal strap.

It is a primary object of this invention to provide a football practice target which will provide the kicker with a device that will aid in improving his skills in placekicking accuracy from various distances.

A further object is to provide a football receiving target that will allow the kicker to retrieve his own kicked footballs with a minimum of ball-return time, and to practice his kicking art in a studious isolated environment, away from the usual practice crowd, alone, and undisturbed by others around him.

It is another object of the present invention to provide a football practice target that can be readily employed for either permanent or temporary durations at practically any out-of-door location, including vacant lots and backyards of urban areas, at play-yards, at "sandlots", and even indoors as within gymnasia.

It is another object of the present invention to provide a football goalpost assembly that is readily assemblable and disassemblable, i.e., dismantleadable, for ease in erection at any desired location, for interim storage, and for shipment between geographically remote locations.

It is a further object to provide a football goalpost assembly that is readily portable for relatively short distances in the assembled form thereof.

It is yet another object to provide a football goalpost assembly having a target member that is dimensionally selectively variable, appropriate to site conditions and to the development of kicking skills, even for younger and physically less mature players.

Other objects and advantages of this invention will become apparent from the following detailed description thereof and the accompanying drawings, wherein.

DESCRIPTION OF THE PREFERRED EMBODIMENT

Figure 1:
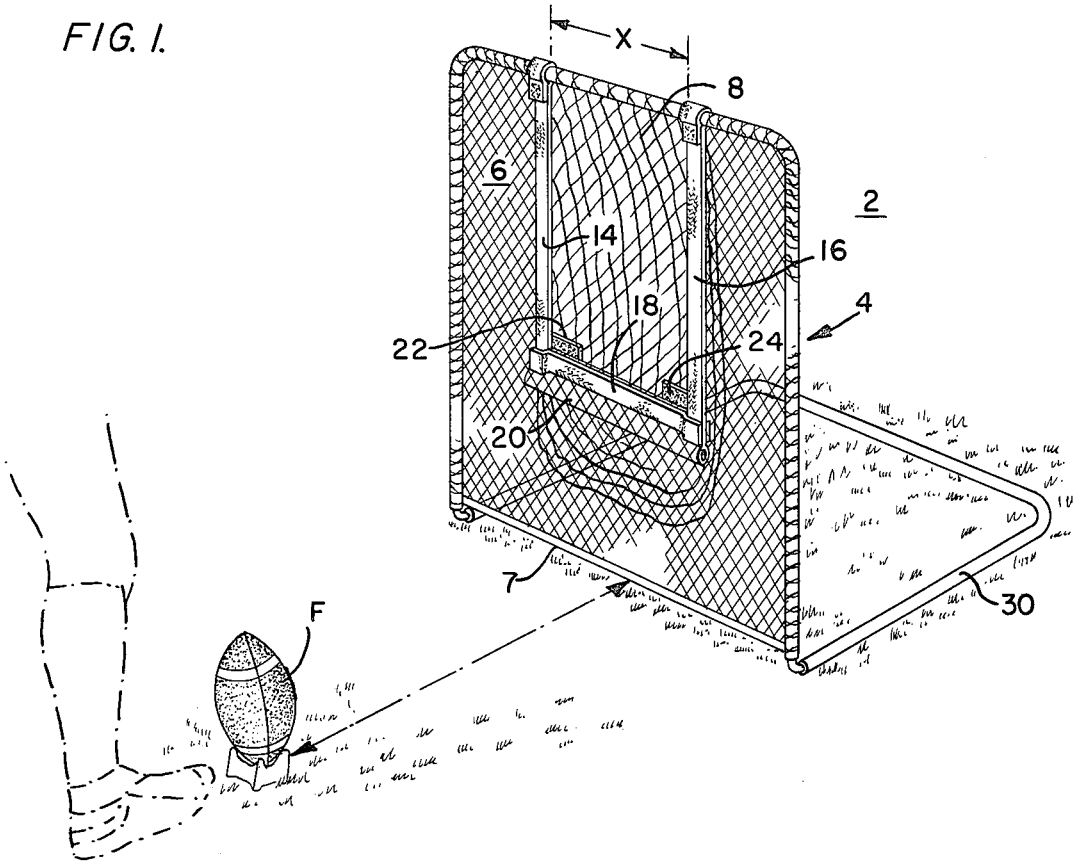
FIG. 1 is a perspective view of a football practice target embodying the invention.
Figure 2:
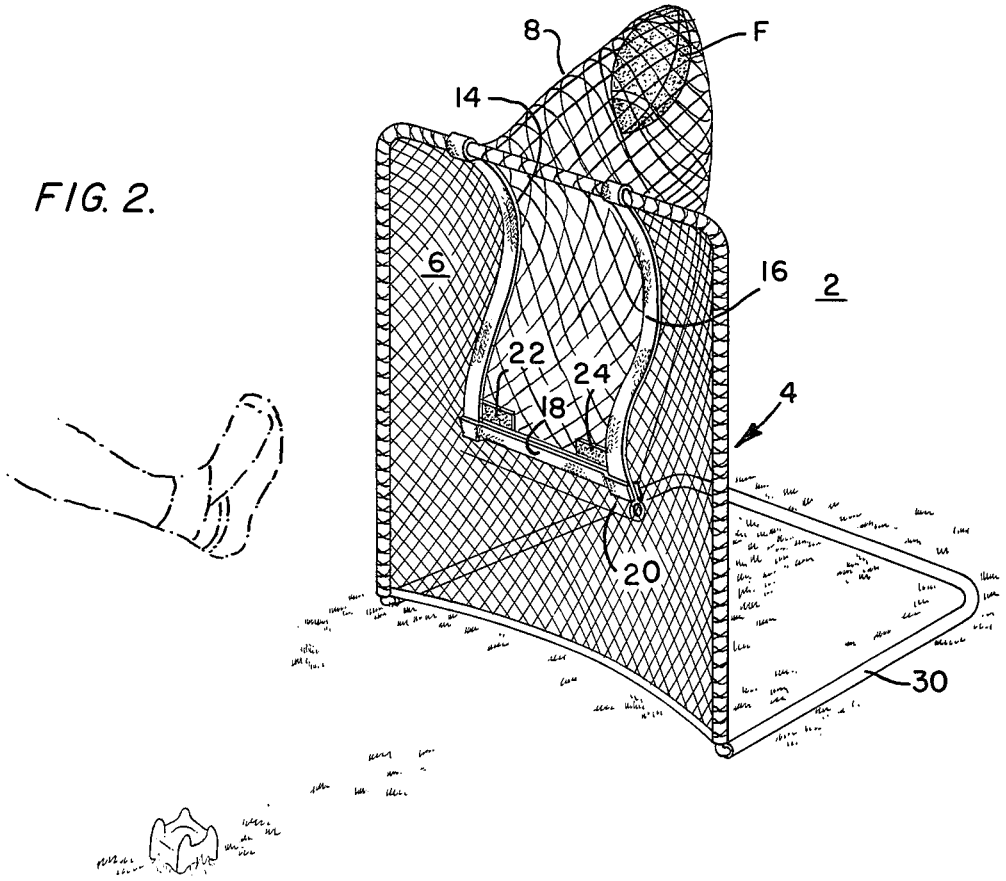
FIG. 2 is a further perspective view of the football practice target of FIG. 1 receiving a kicked ball.

Referring now to the drawings, and particularly to FIGS. 1 and 2, there is shown therein a football practice target generally designated by the reference numeral 2. Practice target 2 includes a frame 4 (shown in FIG. 3) designed to support a backstop net 6 in a vertically disposed position. The net 6 has a rectangular cut-out extending from the top of the net to about 18 inches from the bottom of the net and having a width X (FIG. 1) of about 20 inches centered equally between the side edges of the net. It has been determined that a cut-out beginning 18 inches from the bottom of the net and 20 inches wide is the proper scaled height and width for practicing extra points when a ball is placed 4 feet in front of the net. Sewn to the perimeter of the cut-out is a pocket 8 with an open end 10 and a closed end 12, best shown in FIG. 5. Surrounding the perimeter of the cut-out in net 6 are vertical straps 14 and 16 and horizontal strap 18. Integral with horizontal strap 18 is sleeve 20 adapted to contain a weight W. The sleeve 20 will hang in back of the net 6 so as not to interfere with a kicked ball.

At the corners where vertical straps 14 and 16 and horizontal strap 18 intersect there are tabs 22 and 24. These tabs extend horizontally part way across the opening of pocket 8. The tabs 22 and 24 can be sewn to the net during assembly of the vertical straps and horizontal strap to make a better reinforced finished structure. The face of the tabs 22 and 24 exposed to the front of the net 6 are covered with a self-adhering gripping material 25, adapted to secure a pair of auxiliary straps to the practice target, as will be discussed later. Tabs 22 and 24 may be replaced by a continuous strip of gripping material secured to the front face of horizontal strap 18.

Figure 3:
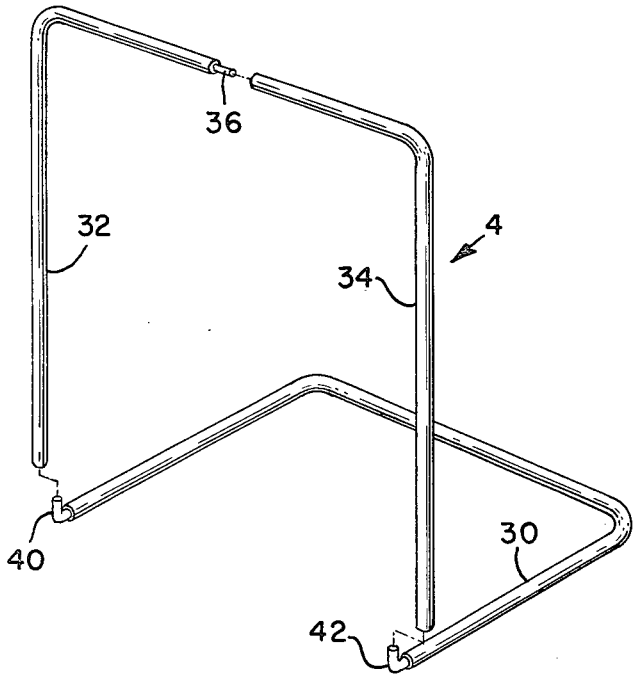
FIG. 3 is a perspective view of a disassembled supporting frame for a football practice target embodying the invention.

The frame 4 shown in FIG. 3 is a knock-down construction having a U-shaped tubular base 30 and a pair of substantially identical L-shaped vertical tubular members 32 and 34. The short horizontal legs of the L-shaped tubular members 32 and 34 are connected together by a connecting pin 36 which is fixed to one of the L-shaped members and slidably connected with the other. When assembled the L-shaped members form a U-shaped rim 4 which is attached to U-shaped base 30 by sliding the free ends of the U-shaped rim 4 over a pair of connecting pins 40 and 42 which are firmly secured to the upstanding free ends of U-shaped base 30.

Figure 4:
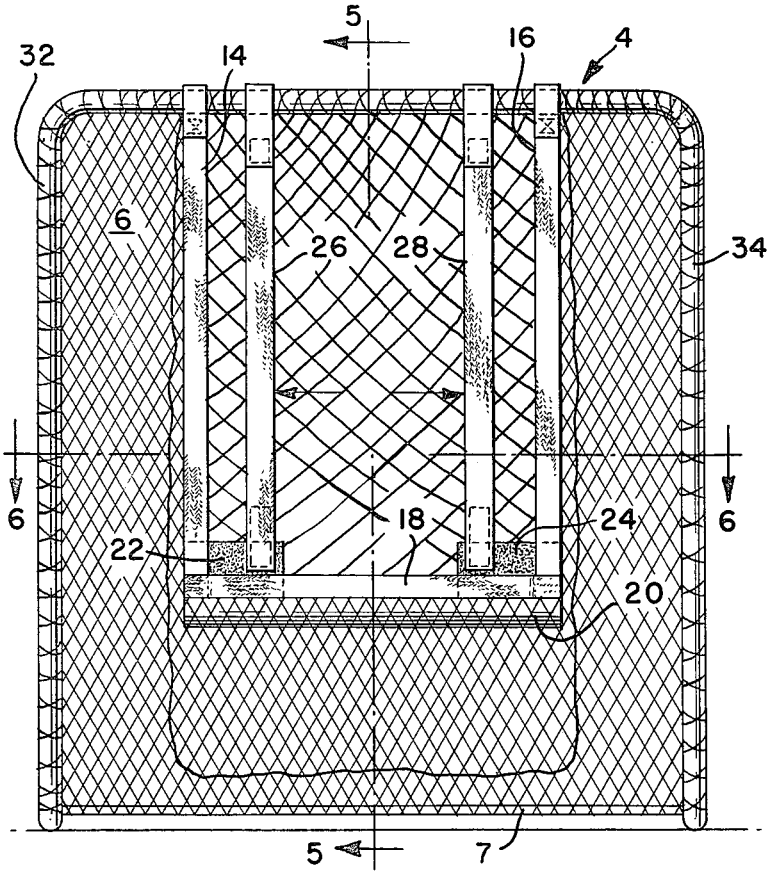
FIG. 4 is a front view of the football practice target of FIG. 1, including auxiliary straps for limiting the width of the target.
Figure 7:
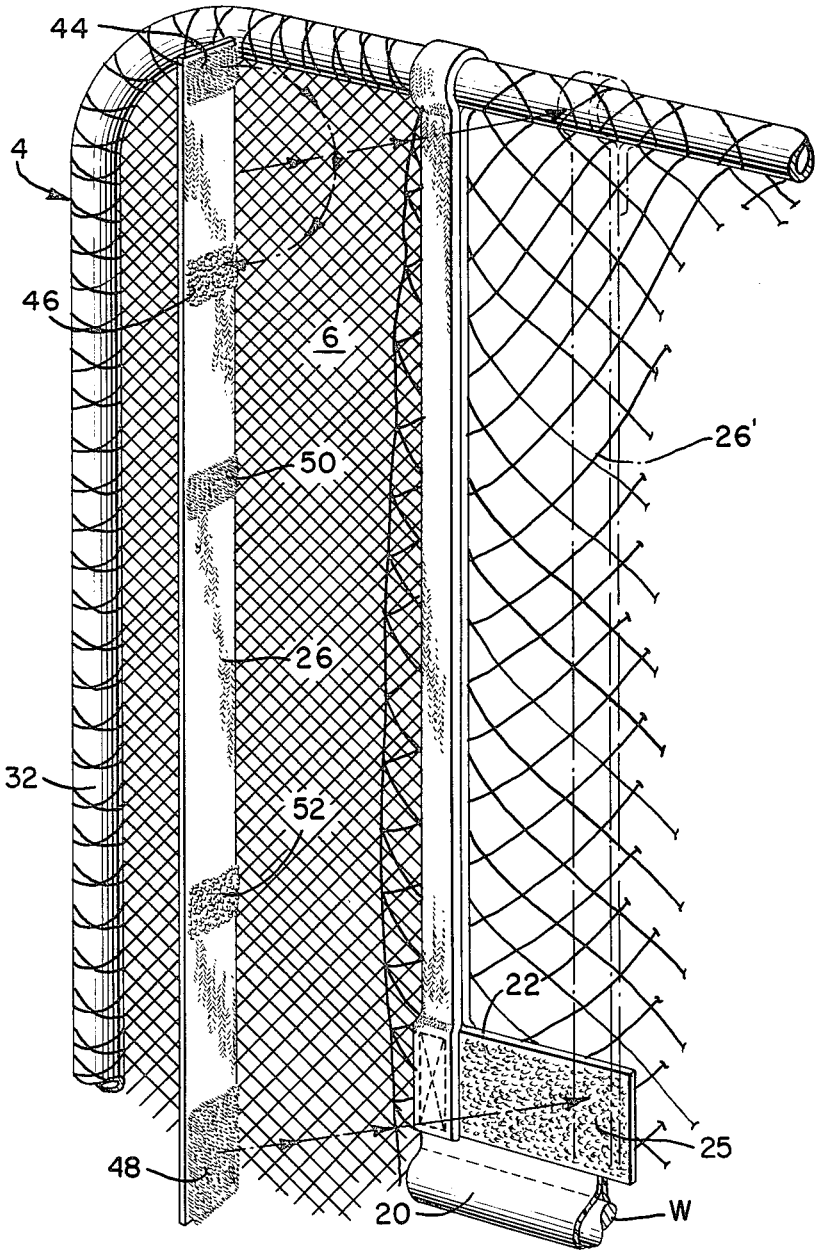
FIG. 7 is a fragmentary perspective view of the football practice target showing one of the removable auxiliary straps prior to being attached.

In FIG. 4 a pair of vertically extending auxiliary straps 26 and 28 are shown removably attached to the horizontal cross bar of the rim 4 and to gripping surfaces 25 of tabs 22 and 24. The auxiliary straps are parallel to vertical straps 14 and 16 with auxiliary strap 26 attached to tab 22 and auxiliary strap 28 attached to tab 24. It can be seen that the width of the open end 10 of pocket 8 is thus limited to the distance between auxiliary straps 26 and 28. It is obvious that the width of the opening 10 can be adjusted by moving the straps 26 and 28 either closer together or further apart. The auxiliary straps 26 and 28 have gripping surfaces 44 and 46 for securing the upper ends of the straps around rim 28, as shown in FIG. 7 where only strap 26 is shown. The strap 26 is wrapped over the horizontal cross bar of rim 38 and gripping surface 44 is secured to gripping surface 46. The auxiliary strap 26 is stretched and a gripping surface 48 is secured to gripping surface 25 of tab 22. There may also be provided a pair of secondary gripping surfaces 50 and 52 in identical locations on auxiliary straps 26 and 28 for raising the position of an auxiliary horizontal cross strap (not shown) to further limit the area of the pocket opening. The gripping surfaces 44, 46 and 48 on the auxiliary 26 and 28 straps and gripping surfaces 25 on tabs 22 and 24 may be of a self-adhering or adhesive material such as Velcro, or some other self-sticking material.

As shown in FIGS. 1, 2, 5 and 7, sleeve 20 is provided a weight W extending horizontally beneath strap 18 which forms the bottom edge of the target cut-out in net 6. When a football is kicked into pocket 8, the weight W aids in absorbing the force of the ball as the pocket 8 is extended upwardly and rearwardly. In addition, the weight W maintains the rectangular configuration of the target cutout by pulling downward on the vertical and horizontal straps to simulate a goalpost.

Figure 5:
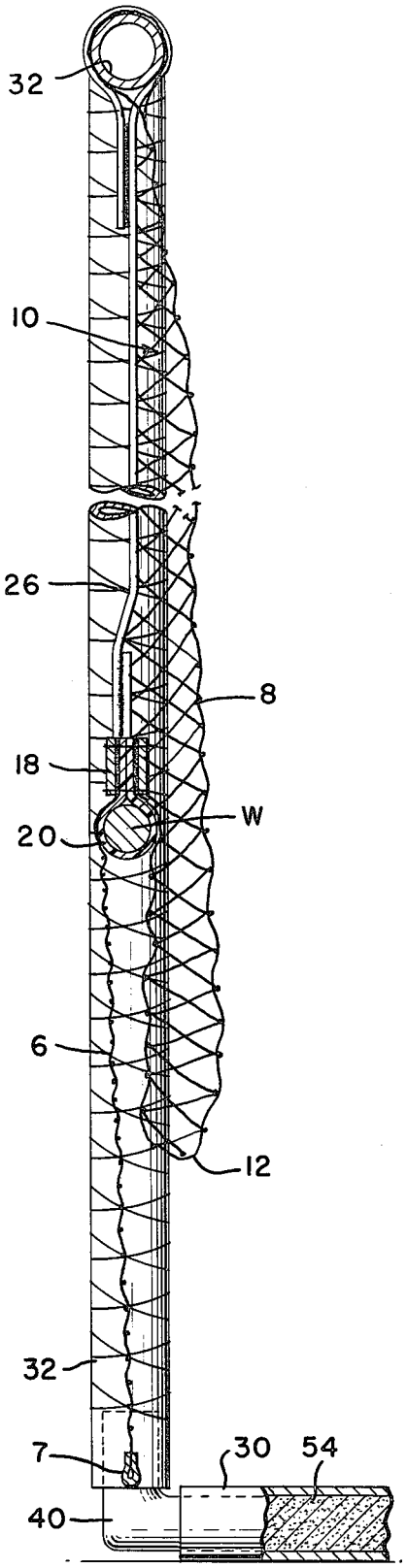
FIG. 5 is a vertical cross-sectional view taken along the line 5—5 of FIG. 4.
Figure 6:
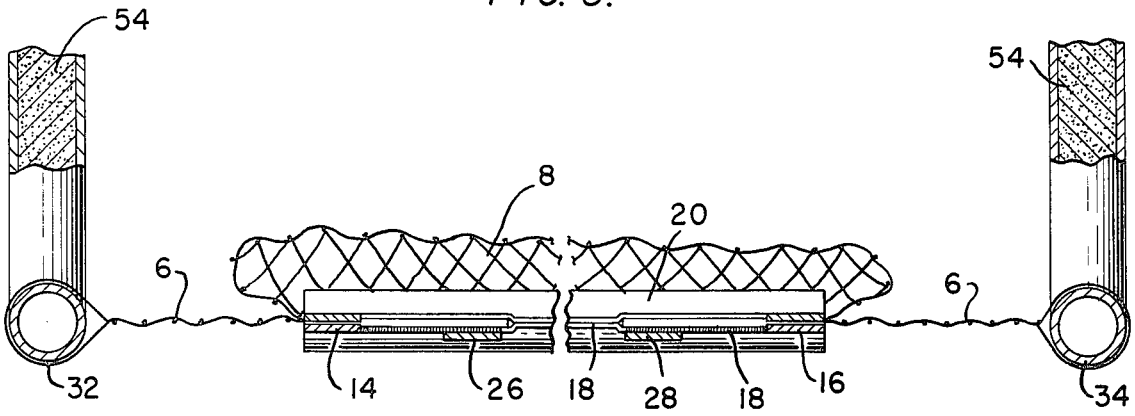
FIG. 6 is a horizontal cross-sectional view taken along the line 6—6 of FIG. 4.

It may be necessary to balance the practice target 2 against tipping over from the force of a kicked football received in pocket 8. To this end, the U-shaped tubular base 30 can be filled with sand 54 or some other material to give the base added weight, as shown in FIGS. 5 and 6.

The net 6 and pocket 8 may be made of any of the conventional cellulose or synthetic fiber cords or synthetic strands commonly used in net making. It is also to be understood that the net and pocket may be formed as an integral structure, in which case vertical straps 14 and 16 and horizontal strap 18 will still define the perimeter of opening 10 of pocket 8.

The material used to make the straps may be a woven or a non-woven fabric of cellulose, nylon or synthetic plastic. It is also contemplated that the front surfaces of vertical straps 14 and 16 may have gripping surfaces to retain auxiliary straps 26 and 28 when not in use.

To use the football practice target 2, a football F if placed on a tee or held on the ground by a player at least 4 feet from the target. Facing the target the kicker should align himself and the ball with the center of the pocket opening 10. The vertical straps 14 and 16 and horizontal strap 18 simulate a goalpost; and when not using the auxiliary straps 24 and 26, the opening 10 of the pocket 8 is approximately the scaled size of a goalpost upright and cross bar when kicking an extra point. Field goal kicks of different distances are practiced without moving the ball further back from the target 2 by using the auxiliary straps 24 and 26 as described above to limit the size of the open end 10 of pocket 8. By moving the auxiliary straps closer to the center of the opening, the size of the target is further restricted, simulating the distance of longer field goals. To practice trajectory, an auxiliary horizontal strap (not shown) can be used to raise the level of the cross bar requiring the ball to be kicked in a higher trajectory.

Although only one specific form of football practice device has been described and illustrated in the accompanying drawings, it will be understood that various modifications and changes may be made by those skilled in the art without departing from the inventive concept. Reference should therefore be had to the appended claims for a definition of the scope of the invention.

I claim:

1. A football receiving target for practicing place-kicking comprising:

a. a vertically disposed frame having a horizontal top cross bar and a pair of vertical legs;

b. a backstop net secured to said frame;

c. a rectangular cutout in said net;

d. a pocket having an open end and a closed end, said open end being secured to the edges of said rectangular cutout;

e. a pair of vertical straps and a horizontal strap attached to said net outlining said open end of said pocket whereby said attached straps simulate a football goalpost; and f. a pair of auxiliary straps removalbly attachable to said horizontal top bar of said frame and to said horizontal strap, said auxiliary straps being attachable parallel to said vertical straps whereby the opening of said pocket may be limited for practicing field goals from different distances.

2. A football receiving target as claimed in claim 1 wherein said vertically disposed frame is a knock-down structure including a pair of substantially identical L-shaped members detachably connected together.

3. A football receiving target as claimed in claim 2 wherein said vertically disposed frame is supported on a U-shaped base having vertically disposed connecting pins in the free ends of said U-shaped base for supporting said L-shaped members thereon.

4. A football receiving target as claimed in claim 1 wherein said vertical straps and said horizontal strap intersect forming corners, and a pair of tabs having gripping faces disposed in each of said corners and extending along said horizontal strap part way across the opening of the open end of said pocket.

5. A football practice target as claimed in claim 4 wherein said removable auxiliary straps include gripping faces for securing said straps to said top cross bar and to the gripping faces of said tabs.

6. A football practice target as claimed in claim 5 wherein said gripping faces comprise a self-adhering material which will cling to itself.

7. A football practice target as claimed in claim 1 wherein said horizontal strap includes a pocket having a weight therein.

8. A football receiving target comprising:

a. a knockdown frame including a vertically disposed U-shaped tubular rim having a top cross bar and vertical legs;

b. a backstop net secured to said rim, said net having a rectangular cutout extending from said cross bar of said rim to a distance less than the total length of said net, the width of said cutout being centered in said net;

c. a pocket having an open end and a closed end, said open end being secured to the perimeter of said net cutout;

a pair of vertical straps and a horizontal strap secured to said net outlining the open end of said pocket; and e. a pair of auxiliary straps removably attached to said top cross bar and to said horizontal strap, whereby said auxiliary straps limit the size of the open end of said pocket and extend from said cross bar substantially parallel to said vertical straps.

9. A football receiving target as claimed in claim 8 wherein said knockdown frame also includes a U-shaped tubular base, said U-shaped tubular rim includes a pair of substantially identical take-apart L-shaped members which connect together to form said cross bar and said vertical legs, said U-shaped base having vertically disposed supporting pins extending from the free ends of said U-shaped base of support said tubular rim.

10. A football practice target as claimed in claim 9 wherein said cutout in said backstop net extends from said top cross bar a distance to about 18 inches from the lower end of said net and the width of said cutout is about 20 inches, and said open end of said pocket has the same dimensions as said cutout.

11. A football practice target as claimed in claim 9 wherein said U-shaped base is filled with a ballast material.

12. A football receiving target comprising:

a. a U-shaped base;

b. a U-shaped frame including a horizontal cross bar and a pair of vertically disposed legs, said frame being formed from a pair of identical L-shaped members joined together to complete said horizontal cross bar;

c. means for detachably connecting said vertically disposed legs to said base;

d. a backstop net stretched across and secured to said frame;

e. a flexible pocket in said backstop net having an open end and a closed end, said open end being attached to said net and forming the middle portion of said net and secured to said cross bar;

f. a pair of vertical straps and a horizontal strap fixed to said net and outlining said open end of said pocket, said horizontal strap outlining the lower horizontal edge of said open end;

g. a pair of tabs with gripping faces affixed to oppositely disposed corners of the open end of said pocket where said vertical straps join said horizontal strap; and h. a pair of auxiliary straps removably attached to said horizontal cross bar and to said gripping faces of said tabs, whereby said auxiliary straps extend substantially parallel to said vertical straps.

13. A football receiving target as claimed in claim 12 wherein said horizontal strap includes a pocket for a weight and said U-shaped base is filled with a ballast material.

* * * * *